US009158257B2

(12) United States Patent
Matsuda

(10) Patent No.: US 9,158,257 B2
(45) Date of Patent: Oct. 13, 2015

(54) IMAGE FORMING APPARATUS

(71) Applicant: KYOCERA Document Solutions Inc., Osaka (JP)

(72) Inventor: Masatomo Matsuda, Osaka (JP)

(73) Assignee: KYOCERA Document Solutions Inc., Tamatsukuri, Chuo-ku Osaka (JP)

( * ) Notice: Subject to any disclaimer, the term of this patent is extended or adjusted under 35 U.S.C. 154(b) by 40 days.

(21) Appl. No.: 14/191,275

(22) Filed: Feb. 26, 2014

(65) Prior Publication Data

US 2014/0241738 A1 Aug. 28, 2014

(30) Foreign Application Priority Data

Feb. 28, 2013 (JP) ..... 2013-039723

(51) Int. Cl.
*B41J 29/38* (2006.01)
*G03G 15/00* (2006.01)
*G03G 21/16* (2006.01)

(52) U.S. Cl.
CPC ..... *G03G 15/55* (2013.01); *G03G 15/6508* (2013.01); *G03G 21/1661* (2013.01)

(58) Field of Classification Search
None
See application file for complete search history.

(56) References Cited

U.S. PATENT DOCUMENTS

| | | | | |
|---|---|---|---|---|
| 4,860,052 | A * | 8/1989 | Ito et al. | 399/24 |
| 5,414,494 | A * | 5/1995 | Aikens et al. | 399/1 |
| 2006/0239731 | A1 * | 10/2006 | Suzuki et al. | 399/389 |
| 2010/0214608 | A1 * | 8/2010 | Maeshima et al. | 358/1.15 |
| 2012/0002223 | A1 * | 1/2012 | Tanaka | 358/1.9 |
| 2013/0027737 | A1 * | 1/2013 | Suzuki | 358/1.14 |

FOREIGN PATENT DOCUMENTS

| | | | | |
|---|---|---|---|---|
| JP | 57209133 | A * | 12/1982 | B65H 1/26 |
| JP | 06271122 | A * | 9/1994 | B65H 3/44 |
| JP | H10-045260 | | 2/1998 | |
| JP | 2007-168102 | | 7/2007 | |

* cited by examiner

*Primary Examiner* — Daniel J Colilla
*Assistant Examiner* — Ruben Parco, Jr.

(57) ABSTRACT

An image forming apparatus includes a cassette chamber, a paper feed cassette, a sheet size sensor, a lift-up sensor, and an arithmetic control unit. The paper feed cassette can be mounted in the cassette chamber, and lifts up a recording sheet placed in the paper feed cassette upon being mounted in the cassette chamber. The arithmetic control unit is configured to decide that the paper feed cassette is mounted when the lift-up sensor detects that the recording sheet is lifted up, despite the sheet size sensor having detected that the paper feed cassette is not mounted.

5 Claims, 7 Drawing Sheets

IMAGE FORMING APPARATUS

INCORPORATION BY REFERENCE

This application claims priority to Japanese Patent Application No.2013-039723 filed on Feb. 28, 2013, the entire contents of which are incorporated by reference herein.

BACKGROUND

1. Technical Field

The present disclosure relates to an image forming apparatus.

2. Related Art

Some of existing image forming apparatuses are configured to avoid erroneously deciding that the recording medium identifier has failed, by restricting, when the built-in CPU decides that the recording medium or the paper feed cassette is absent on the basis of a detection result from the paper sensor, the recording medium identifier from performing a self-diagnosis function for identifying the type of the recording medium according to the level of gloss. In addition, in some image forming apparatuses the paper feed cassette includes a plurality of projecting portions and the main body of the apparatus includes a plurality of switches to be pressed by the respective projecting portions, so that the image forming apparatus can decide whether the paper feed cassette is mounted by detecting a pressed state of the switches, and identify the type of the recording medium placed in the paper feed cassette according to the position of the switch that has been pressed. In the image forming apparatus thus configured, the signal line on one of the sides of the switches is used in common and connected to the ground of the apparatus main body, and the switches do not output a detection signal until the paper feed cassette is mounted in the apparatus main body so that the frame ground of the apparatus main body and the frame ground of the paper feed cassette are brought into contact with each other. Such a configuration prevents erroneous detection of the type of the recording medium originating from irregularity of the timing that each of the switches is pressed.

In the mentioned image forming apparatus, the sensor for detecting whether the paper feed cassette is mounted is located inside a cassette chamber provided in the apparatus main body for mounting the paper feed cassette, so as to detect whether the paper feed cassette is mounted according to whether the paper feed cassette is in contact with the sensor.

SUMMARY

In an aspect, the disclosure proposes further improvement of the foregoing technique.

The disclosure provides an image forming apparatus including a cassette chamber, a paper feed cassette, a cassette detection unit, a lift-up detection unit, and a decision unit.

The paper feed cassette is configured so as to be mounted in the cassette chamber, and to lift up a recording sheet placed in the paper feed cassette upon being mounted in the cassette chamber.

The cassette detection unit is provided in the cassette chamber, and detects whether the paper feed cassette is mounted in the cassette chamber.

The lift-up detection unit is provided in the cassette chamber, and detects whether the recording sheet is lifted up.

The decision unit is configured to decide that the paper feed cassette is mounted when the lift-up detection unit detects that the recording sheet is lifted up, despite the cassette detection unit having detected that the paper feed cassette is not mounted.

DETAILED DESCRIPTION

Hereafter, an embodiment of the disclosure will be described with reference to the drawings.

Figure 1:
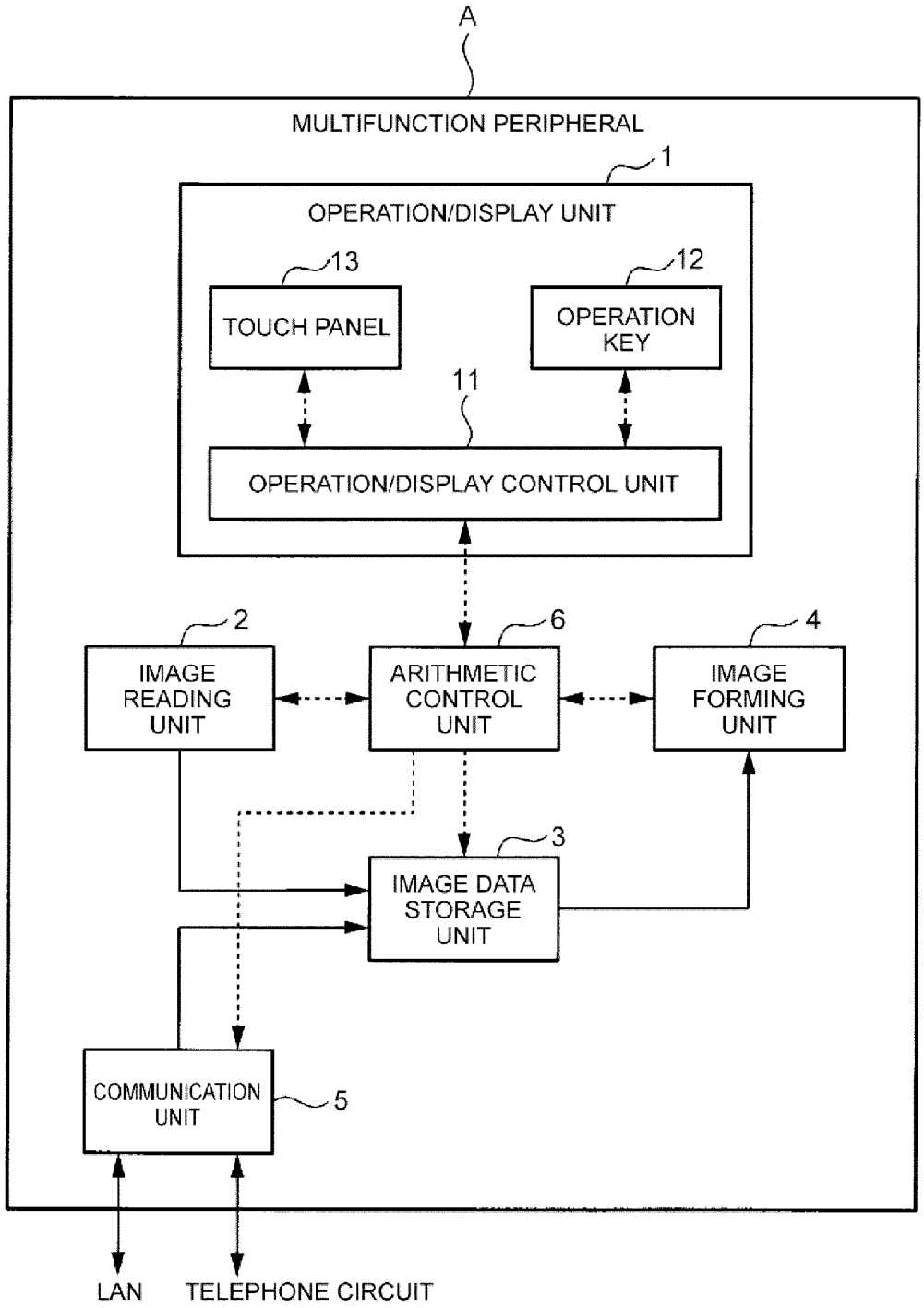
FIG. 1 is a functional block diagram of a multifunction peripheral according to an embodiment of the disclosure.

A multifunction peripheral A according to this embodiment is an image forming apparatus is configured to form an image on a recording sheet by an electrophotography method, and includes, as shown in FIG. 1, an operation/display unit 1, an image reading unit 2, an image data storage unit 3, an image forming unit 4, a communication unit 5, and an arithmetic control unit 6 corresponding to the decision unit and the control unit in the disclosure. Arrows in solid lines in FIG. 1 indicate flows of data, and arrows in broken lines indicate flows of control signals and detection signals.

The operation/display unit 1 includes an operation/display control unit 11, operation keys 12 (see FIG. 2) which are hardware keys, and a touch panel 13 (see FIG. 2) that displays software keys and images, and serves as a man-machine interface that associates a user with the multifunction peripheral A.

The operation/display control unit 11 controls the operation keys 12 and the touch panel 13 under the control of the arithmetic control unit 6, and includes an arithmetic processing unit, an internal memory, and an interface circuit that transmits and receives signals to and from the operation keys 12 and the touch panel 13 electrically connected to each other. The operation/display control unit 11 controls the overall operation of the operation/display unit 1, according to an operation/display control program stored in the internal memory.

For example, the operation/display control unit 11 causes the touch panel 13 to display operation buttons and images by outputting display signals to the touch panel 13. The operation/display control unit 11 also decides, on the basis of an operation signal inputted from the operation keys 12 or the touch panel 13, which of the operation keys 12 or which of the operation buttons displayed on the touch panel 13 has been pressed, and outputs an instruction signal to the arithmetic control unit 6 according to the decision result.

Figure 2:
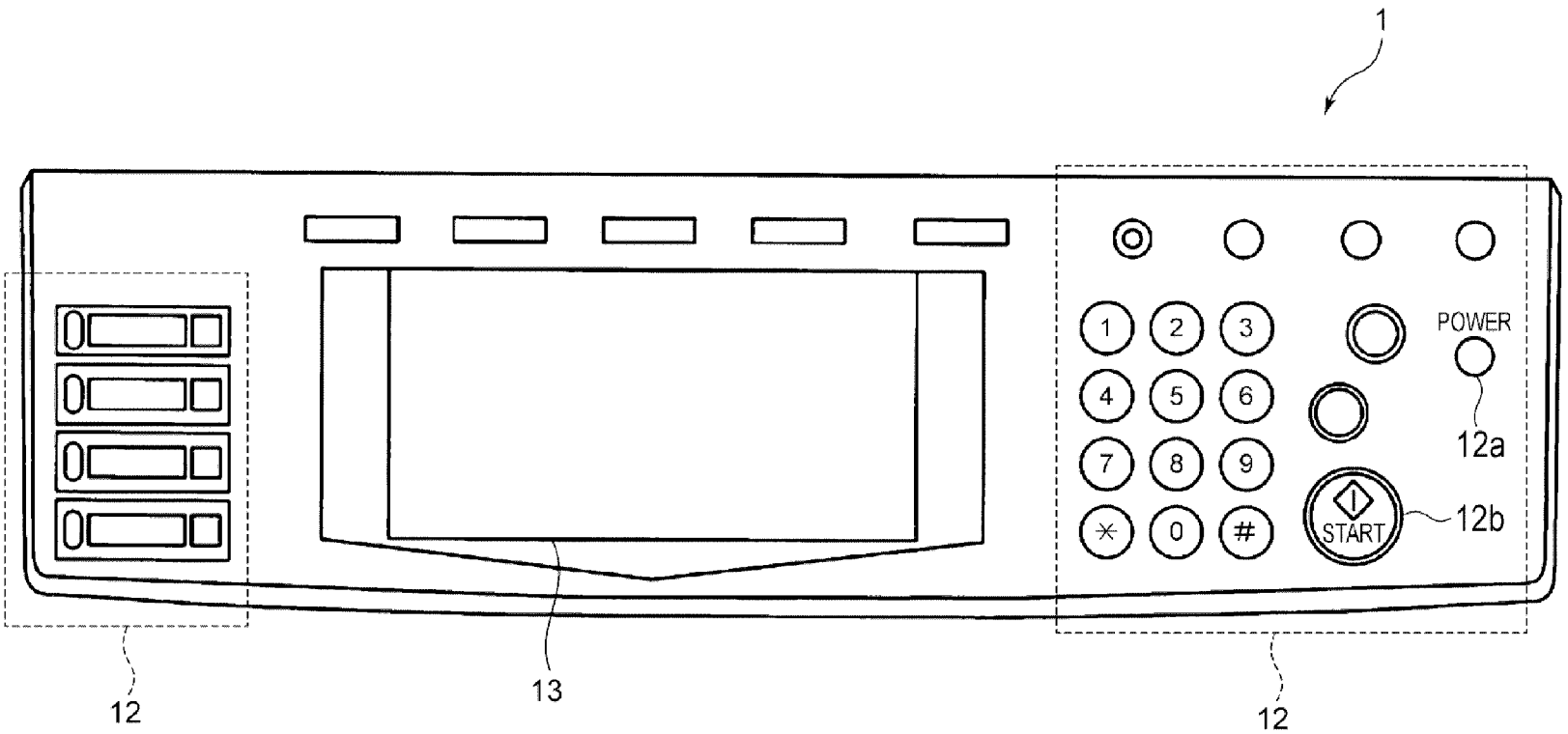
FIG. 2 is a plan view showing an operation/display unit according to the embodiment of the disclosure.

As shown in FIG. 2, the operation keys 12 are physically provided on the operation/display unit 1 as hardware keys, examples of which include a power key, a start key, a stop/clear key, and a ten-key (numeric input key). When the user presses one of the cited keys included in the operation keys 12, an operation signal is outputted from the pressed key to the operation/display control unit 11.

The touch panel 13 is, as widely known, composed of a display panel with a transparent surface pressure sensor formed of a resistive film attached thereto. When one of the operation buttons, displayed on the display panel according to the display signal inputted from the operation/display control unit 11, is pressed by the user's finger, the surface pressure sensor outputs the operation signal indicating the pressed position (coordinate of the pressed point) to the operation/display control unit 11.

Figure 3:
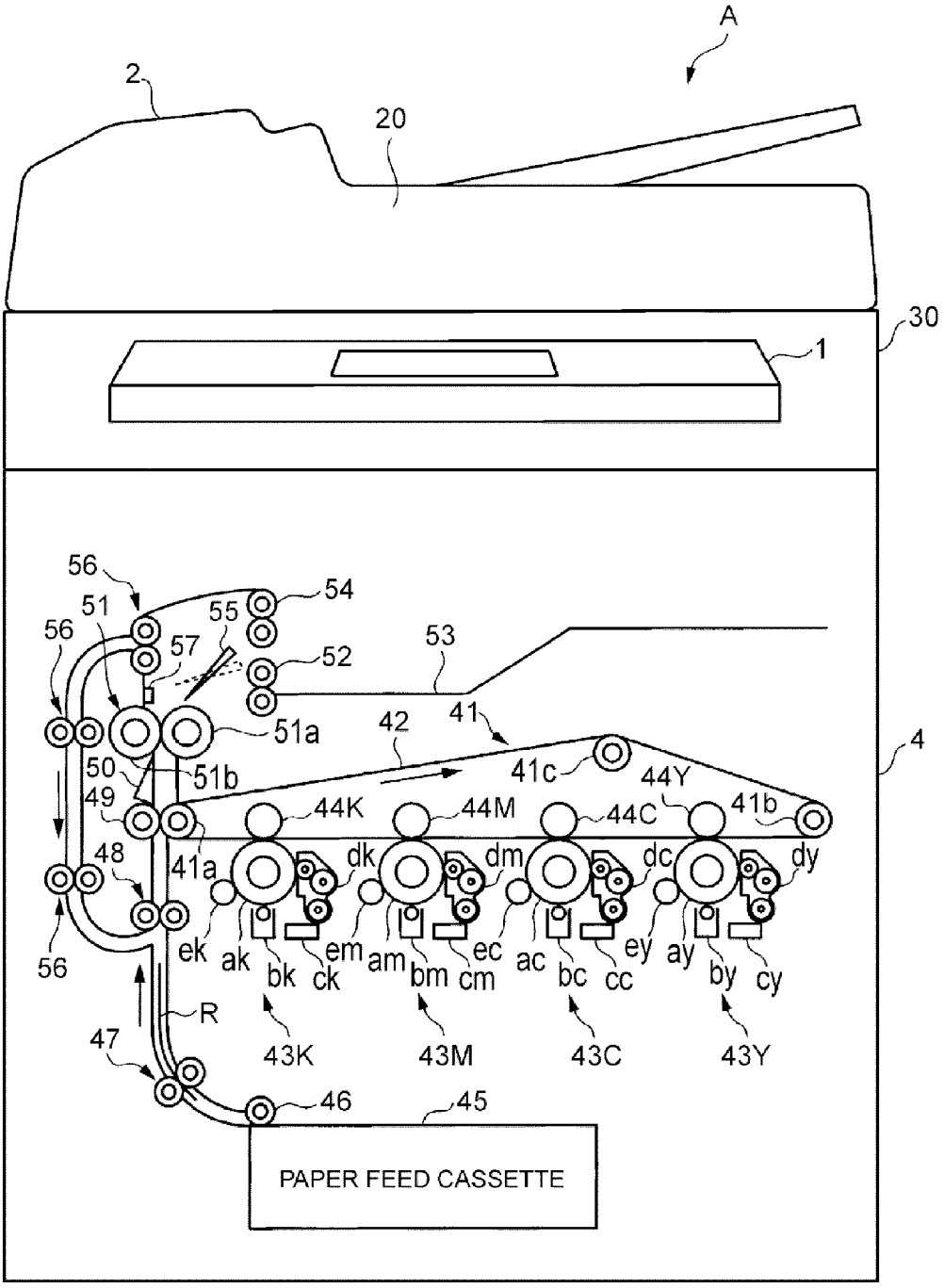
FIG. 3 is a schematic side view showing a mechanical structure of an image forming unit according to the embodiment of the disclosure.

As shown in FIG. 3, the image reading unit 2 includes an automatic document feeder (ADF) 20 and a flatbed reading unit 30. The image reading unit 2 reads an image on the surface of a source document, provided by the ADF 20 according to a control signal inputted from the arithmetic control unit 6 or placed by the user on the flatbed reading unit 30, and converts such a source image into source image data and then outputs the source image data to the image data storage unit 3.

The image data storage unit 3 is for example a semiconductor memory or a hard disk drive. The image data storage unit 3 stores therein, according to the control signal inputted from the arithmetic control unit 6, the source image data, print image data received by the communication unit 5 from an external client computer, and facsimile image data received by the communication unit 5 from an external facsimile machine, and retrieves such image data according to the control signal inputted from the arithmetic control unit 6 and output the data to the image forming unit 4.

The image forming unit 4 forms a toner image based on the image data retrieved from the image data storage unit 3 on a recording sheet R drawn out from the paper feed cassette 45, according to the control signal inputted from the arithmetic control unit 6. The image forming unit 4 includes, as shown in FIG. 3, belt rollers 41, an intermediate transfer belt 42, four image forming units 43Y, 43C, 43M, 43K corresponding to the respective toner colors (Y, M, C, K), primary transfer rollers 44Y, 44C, 44M, 44K, a paper feed cassette 45, a pickup roller 46, a transport roller pair 47, a resist roller pair 48, a secondary transfer roller 49, a charge removing unit 50, a fixing roller pair 51, a discharge roller pair 52, an output tray 53, a reversing roller pair 54, a direction guide 55, three pairs of inverted sheet transport rollers 56, and a recording sheet sensor 57.

The belt rollers 41 include, as shown in FIG. 3, three rollers located separately from each other, namely a drive roller 41*a*, a slave roller 41*b*, and a tension roller 41*c*. To be more detailed, the drive roller 41*a* and the slave roller 41*b* are spaced from each other by a predetermined distance in the horizontal direction, and the tension roller 41*c* is located between the drive roller 41*a* and the slave roller 41*b* at a position slightly displaced upward. The intermediate transfer belt 42 is an endless belt wound over the belt rollers 41, i.e., the drive roller 41*a*, the slave roller 41*b*, and the tension roller 41*c*, and driven to rotate by the drive roller 41*a* in the direction indicated by an arrow in FIG. 3.

Accordingly, the intermediate transfer belt 42 runs in the horizontal direction between the drive roller 41*a* and the slave roller 41*b*. The drive roller 41*a* is axially connected to a motor that generates a driving force, and thus causes the intermediate transfer belt 42 to run as indicated by the arrow, with the driving force of the motor. The slave roller 41*b* is configured to freely rotate, and serves to guide the intermediate transfer belt 42 following up the driving force of the drive roller 41*a*. The tension roller 41*c* has a movable shaft, and serves to press the intermediate transfer belt 42 with a predetermined biasing force, to thereby apply an appropriate tension to the intermediate transfer belt 42.

The image forming units 43Y, 43C, 43M, 43K are aligned at predetermined intervals along the horizontal running section of the intermediate transfer belt 42, as shown in FIG. 3. Among the image forming units 43Y, 43C, 43M, 43K, the image forming unit 43Y is assigned to form a toner image of yellow (Y), and located closest to the slave roller 41*b*. The image forming unit 43C is assigned to form a toner image of cyan (C), and located adjacent to the image forming unit 43Y opposite to the slave roller 41*b*. The image forming unit 43M is assigned to form a toner image of magenta (M), and located adjacent to the image forming unit 43C opposite to the slave roller 41*b*. The image forming unit 43K is assigned to form a toner image of black (K), and located closest to the drive roller 41*a*.

The image forming units 43Y, 43C, 43M, 43K thus configured respectively include photoconductor drums ay, ac, am, ak, charging units by, bc, bm, bk, laser scanning units cy, cc, cm, ck, developing units dy, dc, dm, dk, and cleaners ey, ec, em, ek.

In other words, the image forming unit 43Y includes the photoconductor drum ay, the charging unit by, the laser scanning unit cy, the developing unit dy, and the cleaner ey; the image forming unit 43C includes the photoconductor drum ac, the charging unit bc, the laser scanning unit cc, the developing unit dc, and the cleaner ec; the image forming unit 43M includes the photoconductor drum am, the charging unit bm, the laser scanning unit cm, the developing unit dm, and the cleaner em; and the image forming unit 43K includes the photoconductor drum ak, the charging unit bk, the laser scanning unit ck, the developing unit dk, and the cleaner ek.

The photoconductor drums ay, ac, am, ak are cylindrical members each having an outer circumferential surface formed of a predetermined photosensitive material, such as amorphous silicon. The charging units by, bc, bm, bk serve to uniformly charge the circumferential surface (photosensitive surface) of the photoconductor drums ay, ac, am, ak, respectively. The laser scanning units cy, cc, cm, ck emit a laser beam to the respective photosensitive surfaces that have been charged, to thereby form a static latent image on the photosensitive surfaces.

The developing units dy, dc, dm, dk each store therein a predetermined amount of toner (positive polarity toner) and supply the toner to the photosensitive surface to thereby develop the static latent image formed on the photosensitive surface into a toner image. The cleaners ey, ec, em, ek each scrape off the toner remaining on the photosensitive surface (residual toner) after the toner image is transferred.

The primary transfer rollers 44Y, 44C, 44M, 44K are respectively provided in the image forming units 43Y, 43C, 43M, 43K as shown in FIG. 3, so as to oppose the photoconductor drums ay, ac, am, ak of the image forming units 43Y, 43C, 43M, 43K across the intermediate transfer belt 42. A primary transfer bias (high voltage) of negative polarity is applied to each of the primary transfer rollers 44Y, 44C, 44M, 44K, so that the primary transfer rollers 44Y, 44C, 44M, 44K transfer the toner image of the corresponding color formed on the respective photoconductor drums ay, ac, am, ak of the image forming units 43Y, 43C, 43M, 43K onto the intermediate transfer belt 42, by means of the primary transfer bias (primary transfer).

Figure 4A:
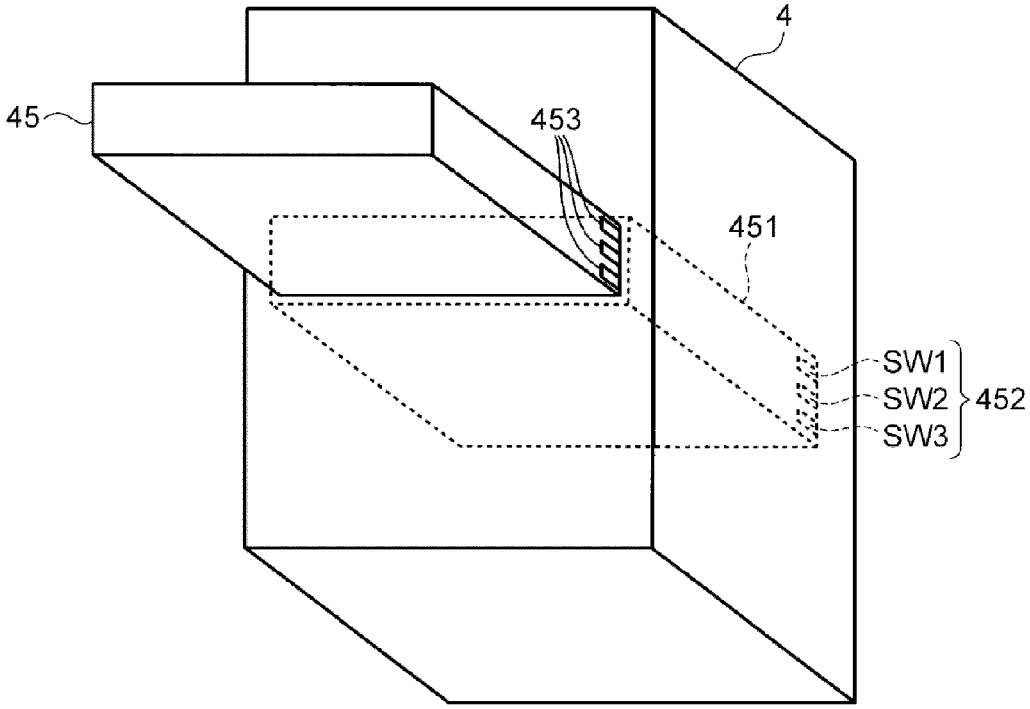
FIG. 4A is a schematic perspective view and FIG. 4B is a schematic side view, each showing a cassette chamber, a sheet size sensor, projecting portions, a lifting plate, lifting plate supporter, a lifting motor and a lift-up sensor according to the embodiment of the disclosure.

The paper feed cassette 45 is a container in which a plurality of recording sheets R of a predetermined size such as A4 or B5 are stacked, and mounted in a cassette chamber 451 formed in the image forming unit 4, as shown in FIG. 4A. A sheet size sensor 452 (cassette detection unit) including micro switches SW1, SW2, SW3 is provided inside the cassette chamber 451. In addition, the paper feed cassette 45 includes a plurality of projecting portions 453 (in this embodiment, three as shown in FIG. 4A) disposed so as to respectively press the micro switches SW1, SW2, SW3 of the sheet size sensor 452 when the paper feed cassette 45 is mounted in the cassette chamber 451.

The projecting portions 453 are attached to the paper feed cassette 45 in different patterns according to the size of the recording sheet R placed in the paper feed cassette 45. Accordingly, the paper feed cassette 45 presses, upon being mounted in the cassette chamber 451, one of the micro switches SW1, SW2, SW3 located at different positions according to the size of the recording sheet R placed in the paper feed cassette 45. The sheet size sensor 452 detects the pressed position and outputs a detection signal to the arithmetic control unit 6. The arithmetic control unit 6 decides whether the paper feed cassette 45 is mounted, as well as the size of the recording sheet R in the paper feed cassette 45, according to the detection signal inputted from the sheet size sensor 452, and stores the size information of the recording sheet R in the paper feed cassette 45. The arithmetic control unit 6 utilizes the size information of the recording sheet R for controlling the image forming unit 4.

Figure 4B:
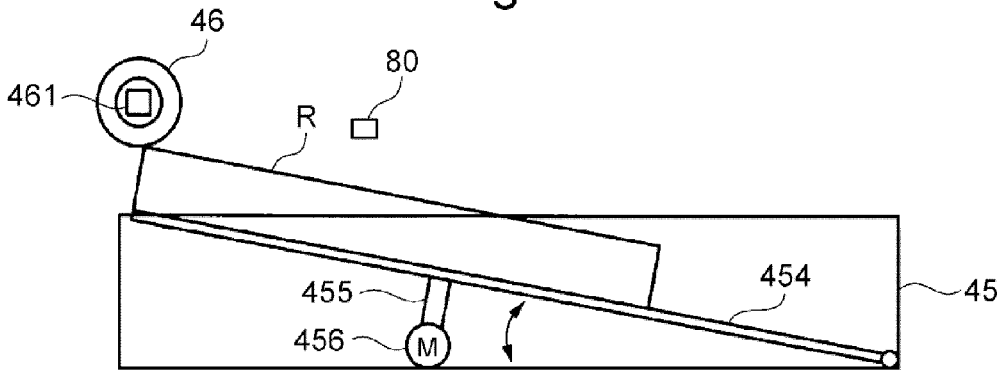

The paper feed cassette 45 also includes, as shown in FIG. 4B, a lifting plate 454, a lifting plate supporter 455 and a lifting motor 456.

The lifting plate 454 serves as the base on which a bundle of the recording sheets R is placed when the recording sheets R are placed in the paper feed cassette 45, and is lifted up by the lifting plate supporter 455 driven by the lifting motor 456 such that the uppermost one of the bundle of the recording sheets R is brought into contact with the pickup roller 46, when the paper feed cassette 45 is mounted in the cassette chamber 451.

A recording sheet sensor 80 including a non-illustrated light emitter and a photodetector is provided above the lifting plate 454. When the paper feed cassette 45 is mounted in the cassette chamber 451, the recording sheet sensor 80 detects light reflected by the bundle of the recording sheets R placed on the lifting plate 454, thus detecting the presence of the recording sheet.

The lifting plate supporter 455 serves to support the lifting plate 454 from the side of the lower face thereof. The lifting plate supporter 455 is connected to the lifting motor 456 and driven by the lifting motor 456 so as to lift up the lifting plate 454.

The lifting motor 456 is a DC brush motor and connected to the lifting plate supporter 455. When the paper feed cassette 45 is mounted in the cassette chamber 451 and the recording sheet sensor 80 detects the presence of the recording sheet R, the lifting motor 456 drives the lifting plate supporter 455 under the control of the arithmetic control unit 6 to lift up the lifting plate 454 such that the uppermost one of the recording sheets R is brought into contact with the pickup roller 46. In contrast, the lifting motor 456 drives the lifting plate supporter 455 under the control of the arithmetic control unit 6 to allow the lifting plate 454 to descend, when the paper feed cassette 45 is removed from the cassette chamber 451.

The pickup roller 46 is disposed above the paper feed cassette 45 so as to contact the recording sheet R with pressure, to thus pick up the recording sheets R in the paper feed cassette 45 one by one and delivers the recording sheet R to the transport roller pair 47. The pickup roller 46 includes a rotary shaft having the end portions supported by a non-illustrated pivotable arm, so as to swing upon being contacted by the recording sheet R lifted up by the lifting plate 454 of the paper feed cassette 45. In other words, the pickup roller 46 is made to move up and downward by the recording sheet R lifted up.

Further, as shown in FIG. 4B, a lift-up sensor 461 (lift-up detection unit) that detects the swinging motion of the pickup roller 46 and outputs the result as a detection signal to the arithmetic control unit 6 is provided in the vicinity of the pickup roller 46. In other words, the lift-up sensor 461 serves to detect whether the recording sheet R is lifted up on the basis of the swinging motion of the pickup roller 46.

The transport roller pair 47 conveys the recording sheet R delivered from the pickup roller 46 to the resist roller 48. The resist roller 48 supplies the recording sheet R delivered from the transport roller pair 47 to the secondary transfer roller 49 at a predetermined timing.

The secondary transfer roller 49 is located opposite the drive roller 41*a* across the intermediate transfer belt 42, and serves to transfer the toner image on the intermediate transfer belt 42 onto the recording sheet R (secondary transfer). A secondary transfer bias (high voltage) of negative polarity is applied to the secondary transfer roller 49, so that the secondary transfer roller 49 transfers the toner image on the intermediate transfer belt 42 onto the recording sheet R, by means of the secondary transfer bias.

The charge removing unit 50 applies a charge removing bias of positive polarity to the recording sheet R according to a control signal inputted from the arithmetic control unit 6. The charge removing bias neutralizes the charge on the recording sheet R thus removing the charge, to facilitate the separation of the recording sheet R from the secondary transfer roller 49. The charge removing unit 50 includes a pin array electrode formed of a stainless steel, and an electric field is generated at the tip portion of the pin array electrode so as to remove the charge of the recording sheet R.

The fixing roller pair 51 includes a heat roller pair 51*a* having a heater thereinside and a pressure roller pair 51*b* pressed against the heat roller pair 51*a*. The fixing roller pair 51 pinches the recording sheet R on which the toner images of the respective colors have been transferred between the heat roller pair 51*a* and the pressure roller pair 51*b* so as to heat the recording sheet R with pressure thereby fixing the toner images on the recording sheet R. The contact surfaces of the heat roller 51*a* and the pressure roller 51*b* brought into contact with the recording sheet R are formed of a fluorine-based material that is negatively charged by friction. Accordingly, the surfaces of the heat roller 51*a* and the pressure roller 51*b* are charged to negative polarity owing to the friction with the recording sheet R.

The discharge roller pair 52 serves to convey the recording sheet R delivered from the fixing roller pair 51 and guided by the direction guide 55 toward the output tray 53. The output tray 53 stores and retains therein the recording sheet R delivered from the discharge roller pair 52. The reversing roller pair 54 transports in a switchback mode the recording sheet R delivered from the fixing roller pair 51 and guided by the direction guide 55. To be more detailed, the reversing roller pair 54 pinches therebetween the recording sheet R delivered from the fixing roller 51 by rotating forward, and delivers the pinched recording sheet R to the inverted sheet transport rollers 56 by rotating backward.

The direction guide 55 selectively switches the direction of the recording sheet R delivered from the fixing roller 51 between the discharge roller pair 52 and the reversing roller pair 54, according to the control signal inputted from the arithmetic control unit 6. When the recording sheet R is to be discharged to the output tray 53 the direction guide 55 assumes a first posture (broken lines in FIG. 3) to thereby guide the recording sheet R to the discharge roller pair 52, but switches the destination of the recording sheet R to the reversing roller pair 54 by assuming a second posture (solid lines in FIG. 3).

The inverted sheet transport rollers 56 are located on the route along which the recording sheet R delivered from the reversing roller pair 54 is transported to the resist roller 48 (reverse route). The inverted sheet transport rollers 56 are located at three positions spaced from each other along the reverse route, as shown in FIG. 3. The recording sheet sensor 57 is located between the fixing roller 51 and the direction guide 55, and serves to detect the number of recording sheets R that have passed the fixing roller 51 and outputs a detection signal indicating the number of sheets to the arithmetic control unit 6.

In the case where the toner image is formed on both sides of the recording sheet R, the reversing roller pair 54, the direction guide 55, and the inverted sheet transport roller 56 collaborate so as to invert the recording sheet R, which has passed the fixing roller 51 upon undergoing the image forming on the front surface, and to deliver the recording sheet R turned front side back to the resist roller 48 again, thereby forming the image on the back surface of the recording sheet R.

The communication unit 5 performs communication with an external multifunction peripheral or a facsimile machine through a telephone circuit, or with a client computer through a local area network (LAN), according to the control signal inputted from the arithmetic control unit 6. For such purpose, the communication unit 5 is equipped with both of the communication function according to a LAN standard such as Ethernet (registered trademark) and the communication function according to a facsimile standard such as G3.

The arithmetic control unit 6 includes a central processing unit (CPU), a read-only memory (ROM), a random-access memory (RAM), and an interface circuit that transmits and receives signals to and from the functional units electrically connected to each other. The arithmetic control unit 6 executes various arithmetic processings according to operation control programs stored in the ROM and performs communication with the functional units, to thereby control the overall operation of the multifunction peripheral A. The arithmetic control unit 6 decides whether the paper feed cassette 45 is mounted in the cassette chamber 451 according to a detection signal inputted from the sheet size sensor 452 and the lift-up sensor 461, the details of which will be subsequently described.

Figure 5:
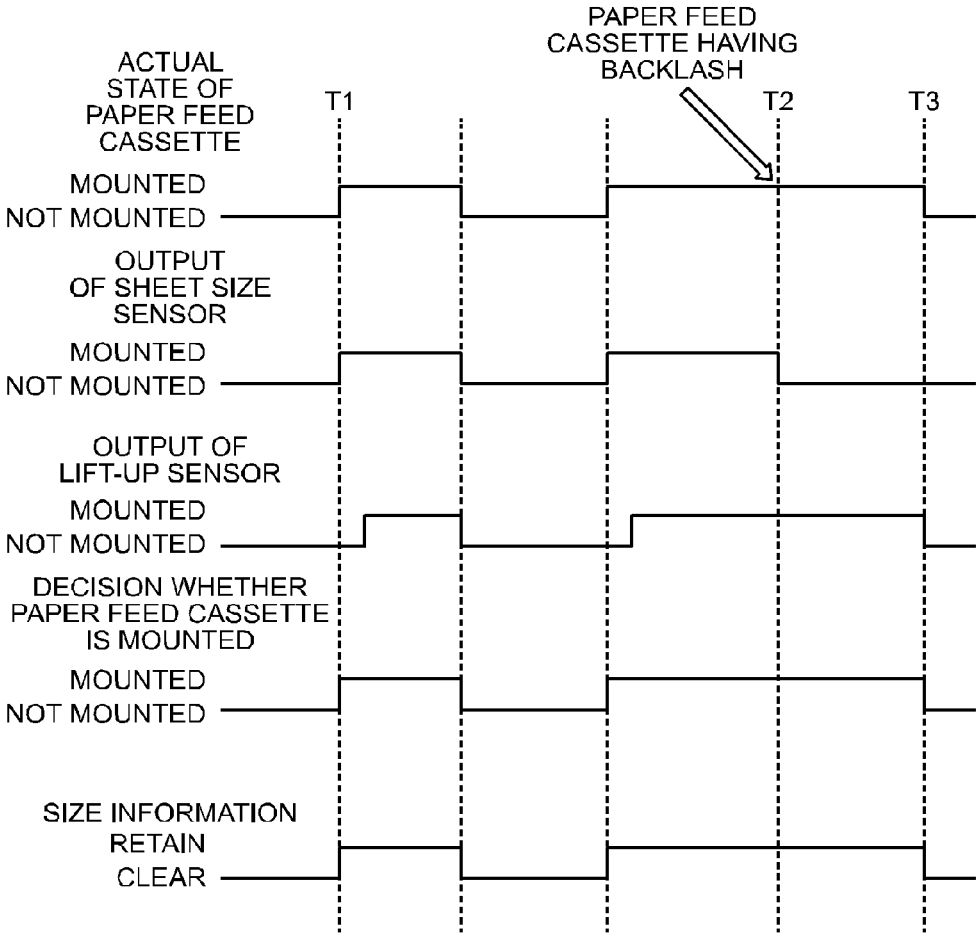
FIG. 5 is a timing chart showing an operation of the multifunction peripheral according to the embodiment of the disclosure.
Figure 6:
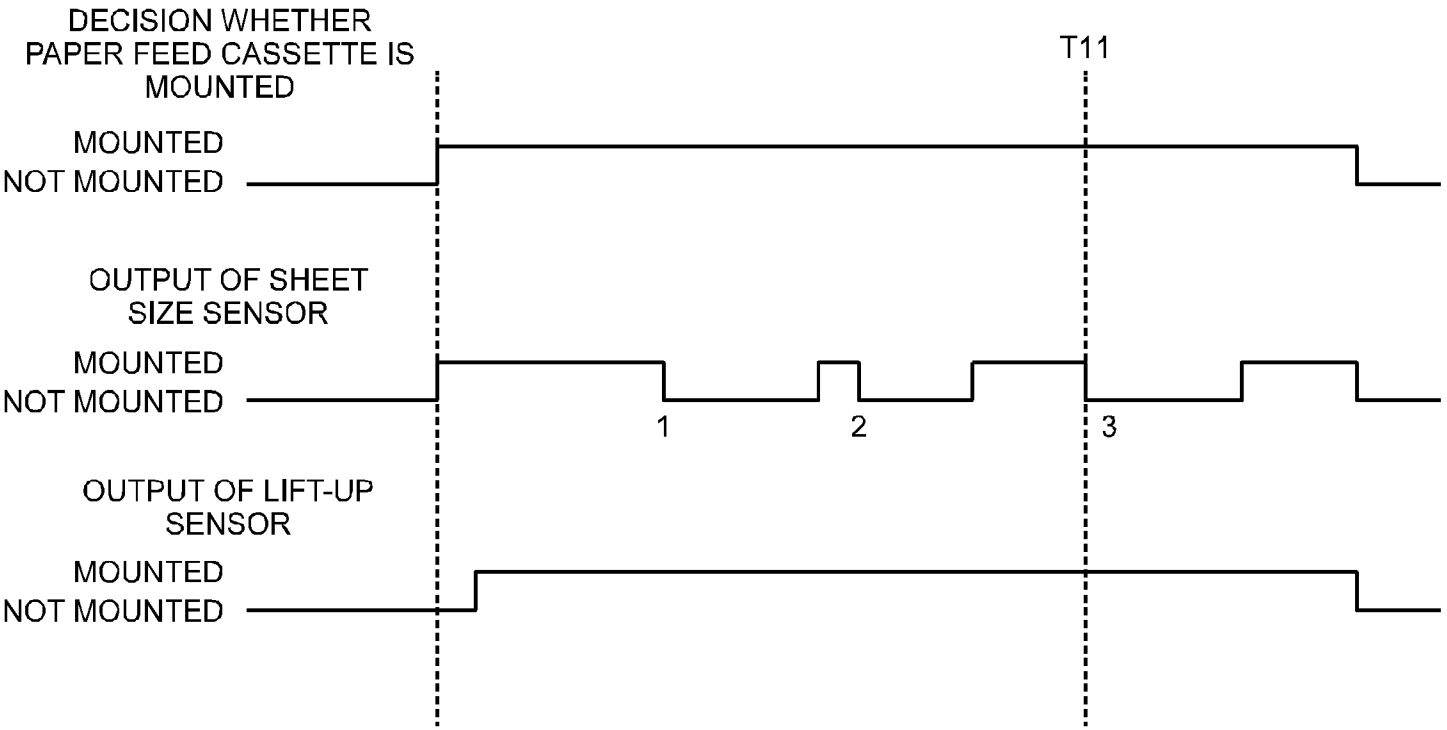
FIG. 6 is a timing chart showing another operation of the multifunction peripheral according to the embodiment of the disclosure.

Referring now to FIGS. 5 and 6, an operation of the multifunction peripheral A thus configured will be described hereunder.

A general operation of the multifunction peripheral A will first be described. For example, when the user instructs copying of a source document on a surface of the recording sheet R by placing the source document on the ADF 20 and manipulating the operation/display unit 1, the signal indicating such an instruction is inputted from the operation/display unit 1 to the arithmetic control unit 6. Accordingly, the arithmetic control unit 6 causes the image reading unit 2 to sequentially read the source image of each page of the source document, and stores the source image data in the image data storage unit 3. Then the arithmetic control unit 6 generates bit map image data corresponding to each of the toner colors according to the source image data, and causes the image forming unit 4 to form the source image on the basis of the bit map image data.

At the same time, the arithmetic control unit 6 drives the pickup roller 46 to draw out the recording sheets R in the paper feed cassette 45 one by one and deliver the recording sheet R to the transport roller pair 47, and drives the transport roller pair 47 to transport the recording sheet R to the resist roller 48. The arithmetic control unit 6 also drives the drive roller 41*a* to cause the intermediate transfer belt 42 to run, and drives the image forming units 43Y, 43C, 43M, 43K so as to form the toner images of the respective positive polarity toner based on the bit map image data, on the photosensitive circumferential surfaces of the photoconductor drums ay, ac, am, ak. Then the arithmetic control unit 6 applies the primary transfer bias of negative polarity to each of the primary transfer rollers 44Y, 44C, 44M, 44K, thereby performing the primary transfer of the toner image on the photoconductor drums ay, ac, am, ak onto the intermediate transfer belt 42.

The arithmetic control unit 6 then drives the resist roller 48 in synchronicity with the image forming operation of each of the image forming units 43Y, 43C, 43M, 43K and causes the secondary transfer roller 49 to apply the secondary transfer bias of negative polarity, thereby performing the secondary transfer of the toner image (source image) on the intermediate transfer belt 42 onto the desired position of the recording sheet R. Thereafter, the arithmetic control unit 6 drives the fixing roller 51 while causing the charge removing unit 50 to apply the charge removing bias of positive polarity thus removing the charge from the recording sheet R, and sets the direction guide 55 to the first posture (broken lines in FIG. 3) so as to transport the recording sheet R toward the discharge roller pair 52. The arithmetic control unit 6 then drives the discharge roller pair 52 so as to deliver the recording sheet R to the output tray 53.

In the case where the user instructs copying of the source document on both sides of the recording sheet R, the arithmetic control unit 6 executes the same operation as above until driving the fixing roller 51, and performs different operation in the subsequent steps. More specifically, upon driving the fixing roller 51 the arithmetic control unit 6 switches the direction guide 55 to the second posture (solid lines in FIG. 3) thereby transporting the recording sheet R toward the reversing roller pair 54. The arithmetic control unit 6 causes the reversing roller pair 54 to rotate forward for a predetermined period of time, and then switches the direction guide 55 to the first posture and causes the reversing roller pair 54 to rotate backward so as to transport the recording sheet R toward the inverted sheet transport roller 56. Thereafter, the arithmetic control unit 6 drives the inverted sheet transport roller 56 to transport the recording sheet R toward the resist roller 48.

Further, the arithmetic control unit 6 forms the toner image representing the positive polarity toner of each color on the photosensitive surface of the corresponding one of the photoconductor drums ay, ac, am, ak. Then the arithmetic control unit 6 applies the primary transfer bias of negative polarity to the primary transfer rollers 44Y, 44C, 44M, 44K, thereby performing the primary transfer of the toner image on the photoconductor drums ay, ac, am, ak onto the intermediate transfer belt 42.

The arithmetic control unit 6 then drives the resist roller 48 in synchronicity with the image forming operation of each of the image forming units 43Y, 43C, 43M, 43K and causes the secondary transfer roller 49 to apply the secondary transfer bias of negative polarity, thereby performing the secondary transfer of the toner image (source image) on the intermediate transfer belt 42 onto the desired position of the recording sheet R. Thereafter, the arithmetic control unit 6 drives the fixing roller 51 while causing the charge removing unit 50 to apply the charge removing bias of positive polarity thus removing the charge from the recording sheet R, and sets the direction guide 55 to the first posture (broken lines in FIG. 3) so as to transport the recording sheet R toward the discharge roller pair 52. The arithmetic control unit 6 then drives the discharge roller pair 52 so as to deliver the recording sheet R to the output tray 53.

Now, the arithmetic control unit 6 performs a distinctive operation as described hereunder. First, the arithmetic control unit 6 decides whether the paper feed cassette 45 is mounted in the cassette chamber 451, according to the detection signal inputted from the sheet size sensor 452. In other words, the arithmetic control unit 6 decides that the paper feed cassette 45 is mounted in the cassette chamber 451 when the sheet size sensor 452 detects the presence of the paper feed cassette 45, as a time point T1 shown in FIG. 5.

In contrast, when the sheet size sensor 452 detects that the paper feed cassette 45 is not mounted, the arithmetic control unit 6 decides whether the paper feed cassette 45 is mounted according to the detection result from the lift-up sensor 461. To be more detailed, as a time point T2 in FIG. 5, the arithmetic control unit 6 decides that the paper feed cassette 45 is mounted in the cassette chamber 451, when the lift-up sensor 461 detects that the recording sheet R is lifted up, despite the sheet size sensor 452 having detected that the paper feed cassette 45 is not mounted.

After a long-term use, the paper feed cassette 45 may become unstably mounted in the cassette chamber 451, for example when the recording sheets R are refilled, owing to backlash produced with the lapse of time, and the projecting portions 453 of the paper feed cassette 45 may fail to properly contact the micro switches SW1, SW2, SW3 of the sheet size sensor 452. Even in such a case, the arithmetic control unit 6 decides that the paper feed cassette 45 is mounted in the cassette chamber 451 despite the sheet size sensor 452 having detected that the paper feed cassette 45 is not mounted, provided that lift-up sensor 461 detects that the recording sheet R is lifted up.

In the case where the sheet size sensor 452 detects that the paper feed paper feed 45 is not mounted and the lift-up sensor 461 detects that the recording sheet R is not lifted up as a time point T3 in FIG. 5, the arithmetic control unit 6 decides that the paper feed cassette 45 is not mounted in the cassette chamber 451. In other words, the arithmetic control unit 6 decides that the paper feed cassette 45 is not mounted in the cassette chamber 451, when the paper feed cassette 45 is removed from the cassette chamber 451 and the lifting plate 454 descends so as to release the recording sheet R from the lifted position.

Further, when the sheet size sensor 452 detects the presence of the paper feed cassette 45 as the time point T1 in FIG. 5, the arithmetic control unit 6 retains size information of the recording sheet R placed in the paper feed cassette 45. In contrast, in the case where the arithmetic control unit 6 decides that the paper feed cassette 45 is mounted according to the detection result from the lift-up sensor 461, despite the sheet size sensor 452 having detected that the paper feed cassette is not mounted as the time point T2 in FIG. 5, the arithmetic control unit 6 continues to retain the size information of the recording sheet R, but clears the size information of the recording sheet R in the case where the arithmetic control unit 6 decides that the paper feed cassette 45 is not mounted according to the detection results from the sheet size sensor 452 and the lift-up sensor 461 as the time point T3 in FIG. 5.

Figure 7:
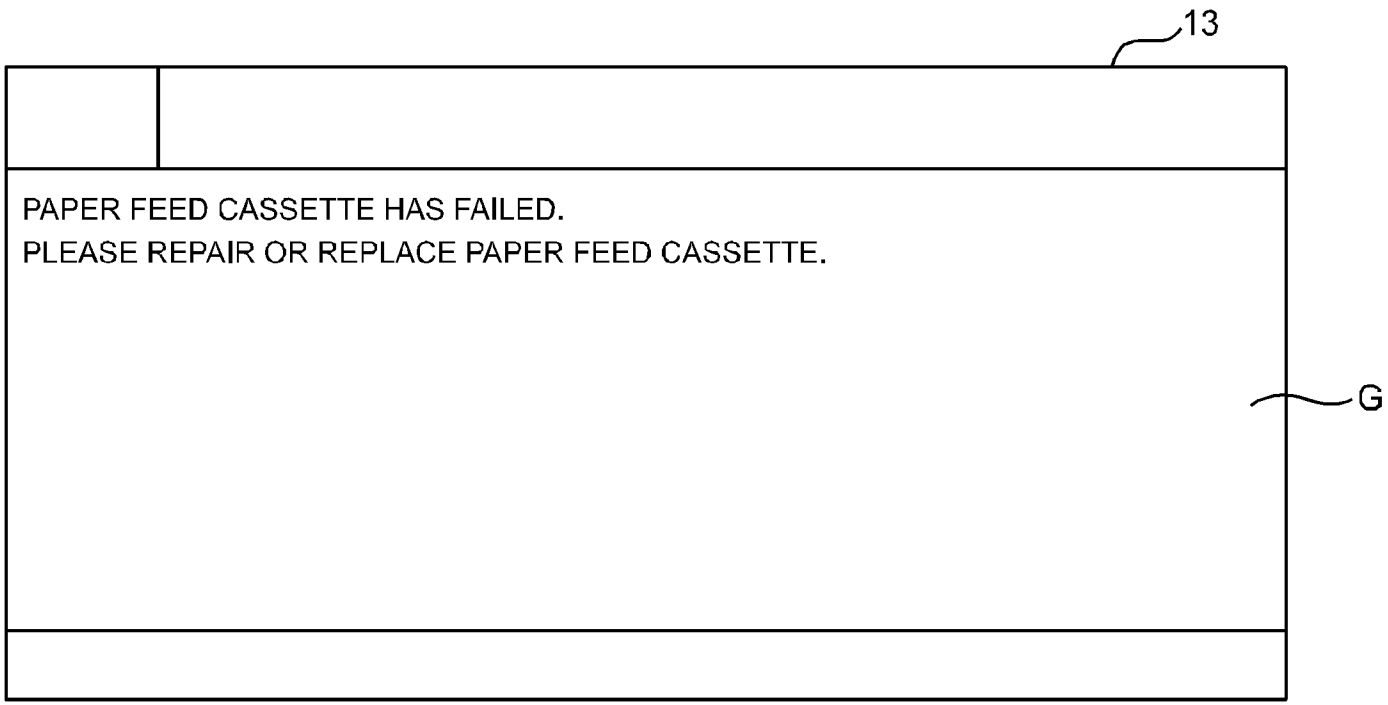
FIG. 7 is a schematic drawing showing a notice screen displayed in a touch panel and notifying a failure of a paper feed cassette, according to the embodiment of the disclosure.

Further, the arithmetic control unit 6 counts the number of times that the paper feed cassette 45 has been decided to be mounted according to the detection result from the lift-up sensor 461 (that the recording sheet R is lifted up) despite the sheet size sensor 452 having detected that the paper feed cassette 45 is not mounted. Then the arithmetic control unit 6 decides whether the number of times counted has reached a predetermined threshold (for instance, three times). The arithmetic control unit 6 displays, upon deciding that the number of times that the paper feed cassette 45 has been decided to be mounted has reached the threshold, for example at a time point T11 shown in FIG. 6, a notice screen G (see FIG. 7) on the touch panel 13 for notifying to the effect that the paper feed cassette 45 has failed. In contrast, in the case where the arithmetic control unit 6 decides that the number of times that the paper feed cassette 45 has been decided to be mounted has not reached the threshold, the arithmetic control unit 6 does not allow the notice screen G to be displayed on the touch panel 13 for notifying to the effect that the paper feed cassette 45 has failed, until the number of times reaches the threshold.

In conventional image forming apparatuses, generally, a sensor for detecting the presence of the paper feed cassette is disposed in a cassette chamber provided in the apparatus main body in which the paper feed cassette is to be mounted, so as to detect the presence of the paper feed cassette depending on whether the sensor is contacted by the paper feed cassette. With such a configuration, however, the paper feed cassette becomes unstably mounted in the cassette chamber, for example when the recording sheets are refilled, owing to backlash produced with the lapse of time, in which case the paper feed cassette fails to properly contact the sensor and is hence erroneously detected not to have been mounted. Thus, the conventional configuration has a drawback in that the paper feed cassette may fail to be properly detected.

The image forming apparatus according to this embodiment, in contrast, is configured to decide that the paper feed cassette 45 is mounted in the case where the lift-up sensor 461 detects the presence of the paper feed cassette 45, despite the sheet size sensor 452 having detected that the paper feed cassette 45 is not mounted. Therefore, the presence of the paper feed cassette 45 can be correctly detected even though the paper feed cassette 45 is mounted in the cassette chamber 451 with backlash. According to this embodiment, further, the notice screen G (see FIG. 7) for notifying to the effect that the paper feed cassette 45 has failed is displayed on the touch panel 13, in the case where the number of times that the paper feed cassette 45 has been decided to be mounted according to the detection result from the lift-up sensor 461 despite the sheet size sensor 452 having detected that the paper feed cassette 45 is not mounted has reached the threshold. Therefore, the user can repair or replace the paper feed cassette 45 before the paper feed cassette 45 becomes completely unusable.

Although the embodiment of the disclosure has been described as above, the foregoing embodiment may be modified, for example as described hereunder.

(1) In the foregoing embodiment, the notice screen G (see FIG. 7) for notifying to the effect that the paper feed cassette 45 has failed is displayed on the touch panel 13, in the case where the number of times that the paper feed cassette 45 has been decided to be mounted according to the detection result from the lift-up sensor 461 despite the sheet size sensor 452 having detected that the paper feed cassette 45 is not mounted has reached the predetermined threshold, however the disclosure is not limited to such an arrangement. For example, the arithmetic control unit 6 may display the notice screen G for notifying to the effect that the paper feed cassette 45 has failed on the touch panel 13, each time the paper feed cassette 45 is decided to be mounted according to the detection result from the lift-up sensor 461 despite the sheet size sensor 452 having detected that the paper feed cassette 45 is not mounted. Further, the arithmetic control unit 6 may accept the number of times inputted by the user through the operation keys 12 or the touch panel 13, and may change the threshold according to the number of times accepted.

(2) Although the sheet size sensor 452 serving as the cassette detection unit is configured to detect whether the paper feed cassette 45 is mounted as well as the size of the recording sheet R placed in the paper feed cassette 45 in the foregoing embodiment, for example a sensor that simply detects the presence of the paper feed cassette 45 may be employed as the cassette detection unit.

(3) Although the lift-up sensor 461 that detects the swinging motion of the pickup roller 46 is employed as the lift-up detection unit in the foregoing embodiment, for example a sensor that detects that the recording sheet R is lifted up upon being contacted by the recording sheet R lifted up, such as a limit switch, may be employed as the lift-up detection unit.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a cassette chamber;

a paper feed cassette configured so as to be mounted in the cassette chamber, and to lift up a recording sheet placed in the paper feed cassette upon being mounted in the cassette chamber;

a cassette detection unit provided in the cassette chamber, and configured to detect whether the paper feed cassette is mounted in the cassette chamber;

a lift-up detection unit provided in the cassette chamber, and configured to detect whether the recording sheet is lifted up; and a decision unit configured to decide that the paper feed cassette is mounted when the lift-up detection unit detects that the recording sheet is lifted up, despite the cassette detection unit having detected that the paper feed cassette is not mounted.

2. The image forming apparatus according to claim 1, further comprising:

a display unit configured to display an image; and a control unit configured to cause the display unit to display a notice to the effect that the paper feed cassette has failed in the case where the decision unit decides that the paper feed cassette is mounted according to a detection result from the lift-up detection unit, despite the cassette detection unit having detected that the paper feed cassette is not mounted.

3. The image forming apparatus according to claim 2, wherein the control unit is configured to count the number of times that the decision unit has decided that the paper feed cassette is mounted according to the detection result from the lift-up detection unit despite the cassette detection unit having detected that the paper feed cassette is not mounted, and to cause the display unit to display the notice to the effect that the paper feed cassette has failed.

4. The image forming apparatus according to claim 3, wherein the control unit is configured to accept a value inputted by the user, and to change the threshold according to the value accepted.

5. The image forming apparatus according to claim 1, wherein the cassette detection unit includes a plurality of switches disposed in the cassette chamber and is configured to output a state of the switches pressed by the paper feed cassette as a detection result, the paper feed cassette includes a projecting portion that presses one of the switches located at different positions, according to a size of the recording sheet placed in the paper feed cassette, and the decision unit is further configured to (i) identify the size of the recording sheet placed in the paper feed cassette, in addition to whether the paper feed cassette is mounted, according to the detection result from the cassette detection unit, (ii) retain size information of the recording sheet placed in the paper feed cassette in the case where the cassette detection unit has detected that the paper feed cassette is mounted, (iii) continue to retain the size information of the recording sheet in the case where the decision unit decides that the paper feed cassette is mounted despite the cassette detection unit having detected that the paper feed cassette is not mounted, and (iv) clear the size information of the recording sheet in the case where the decision unit decides that the paper feed cassette is not mounted according to detection results from the cassette detection unit and the lift-up detection unit.

* * * * *